US008859916B2

(12) United States Patent
Serpinet et al.

(10) Patent No.: US 8,859,916 B2
(45) Date of Patent: Oct. 14, 2014

(54) ELECTRICAL CUT-OFF DEVICE WITH HIGH MAKING CAPACITY

(75) Inventors: Marc Serpinet, Sundhouse (FR); Yves Trichard, Colmar (FR); Arnaud Marchal, Ebersheim (FR)

(73) Assignee: Socomec S.A., Benfeld (FR)

( * ) Notice: Subject to any disclaimer, the term of this patent is extended or adjusted under 35 U.S.C. 154(b) by 77 days.

(21) Appl. No.: 13/598,827

(22) Filed: Aug. 30, 2012

(65) Prior Publication Data

US 2013/0056339 A1 Mar. 7, 2013

(30) Foreign Application Priority Data

Sep. 1, 2011 (FR) ..... 11 57713

(51) Int. Cl.

| | |
|---|---|
| ***H01H 31/02*** | (2006.01) |
| ***H01H 31/28*** | (2006.01) |
| ***H01H 31/32*** | (2006.01) |
| ***H01H 73/04*** | (2006.01) |
| ***H01H 9/40*** | (2006.01) |
| ***H01H 1/22*** | (2006.01) |

(52) U.S. Cl.

CPC ..... *H01H 1/226* (2013.01); *H01H 73/04* (2013.01); *H01H 9/40* (2013.01)

USPC ..... 200/48 R

(58) Field of Classification Search

USPC ..... 200/293, 296, 297, 5 R, 5 B, 5 C, 6 R, 200/19.18, 19.2, 19.22, 19.27, 19.3, 49, 200/553, 558, 339, 48 R

See application file for complete search history.

(56) References Cited

U.S. PATENT DOCUMENTS

| | | | | |
|---|---|---|---|---|
| 2,356,040 | A | 8/1944 | Ellis et al. | |
| 3,319,199 | A | 5/1967 | Bauer | |
| 4,633,207 | A | 12/1986 | McClellan et al. | |
| 5,794,763 | A * | 8/1998 | Ogasawara | 200/401 |
| 6,317,019 | B1 * | 11/2001 | Herpin et al. | 335/8 |
| 2003/0038695 | A1 | 2/2003 | Kramer | |
| 2010/0026427 | A1 | 2/2010 | Moeller et al. | |

FOREIGN PATENT DOCUMENTS

| | | |
|---|---|---|
| BE | 661 103 | 7/1965 |
| DE | 741 311 | 11/1943 |
| EP | 0 199 668 A2 | 10/1986 |
| EP | 0 473 014 A2 | 3/1992 |
| EP | 1 026 710 A2 | 8/2000 |

(Continued)

OTHER PUBLICATIONS

French Search Report Corresponding to FR 11/57712.

(Continued)

*Primary Examiner* — Edwin A. Leon
*Assistant Examiner* — Anthony R. Jimenez
(74) *Attorney, Agent, or Firm* — Davis & Bujold, PLLC; Michael J. Bujold

(57) ABSTRACT

An electrical cut-off device provided with a control module associated with at least one cut-off module corresponding to a phase of an electrical network in which the cut-off module includes a set (5) of several moving contacts (5A-C) associated with one pair of fixed contacts. The moving contacts of the set (5) of several moving contacts (5A-C) are parallel and offset with respect to one another in order to stagger, in time, an the approach of the moving contacts with the pair of fixed contacts when closing the electrical circuit.

13 Claims, 3 Drawing Sheets

(56) References Cited

FOREIGN PATENT DOCUMENTS

| | | | |
|---|---|---|---|
| EP | 1 085 610 | A1 | 3/2001 |
| FR | 2 188 292 | | 1/1974 |
| FR | 2 383 513 | A1 | 10/1978 |
| FR | 2 524 195 | A1 | 3/1982 |
| FR | 2 516 699 | A1 | 5/1983 |
| FR | 2 638 017 | A1 | 4/1990 |
| FR | 2 756 412 | A1 | 5/1998 |
| FR | 2818434 | A1 | 6/2002 |
| FR | 2 891 395 | A1 | 3/2007 |
| GB | 2 096 396 | A | 10/1982 |
| GB | 2 384 626 | A | 7/2003 |
| WO | 2006/137687 | A1 | 12/2006 |
| WO | 2007/036624 | A1 | 4/2007 |

OTHER PUBLICATIONS

French Search Report Corresponding to FR11/57713.
French Search Report Corresponding to FR11/57714.

* cited by examiner

ELECTRICAL CUT-OFF DEVICE WITH HIGH MAKING CAPACITY

This application claims priority from French patent application serial no. 11/57713 filed Sep. 1, 2011.

FIELD OF THE INVENTION

The present invention relates to an electrical cut-off device with high making capacity provided with a control module associated with at least one cut-off module corresponding to a phase of an electrical network, this cut-off module including at least one moving contact associated with at least one pair of fixed contacts, said moving contact being coupled with an actuator mechanism controlled by said control module so as to be moved between at least one switched-off position in which the moving contact is distant from the pair of fixed contacts and the electrical circuit is open, and a switched-on position in which the moving contact is resting on the pair of fixed contacts and the electrical circuit is closed.

BACKGROUND OF THE INVENTION

An example of this type of cut-off device is described in publications FR 2 818 434 and FR 2 891 395 by the same applicant and relates in particular to switches, fuse switches, commutators, reversing switches, circuit breakers or similar appliances.

To establish an electrical current, an electrical device comprises at least a pair of fixed contacts and one moving contact. When closing the electrical circuit, the moving contact is brought against the fixed contact. To ensure the quality of the electrical contact, which is the guarantee for the proper operation of the device, the movement of the moving contact during its approach stroke must be independent of any external action. To that purpose, the device includes a contact closing and opening mechanism, called also actuator mechanism, which consists in an operator-independent snap closing mechanism. During closing, this mechanism gives the moving contact a displacement speed of the order of some m/s. In this period, the moving contact gains a certain quantity of kinetic energy. This results in a shock when the moving contact comes into contact with the fixed contact. The kinetic energy of the moving contact is transformed into material deformation and into an inversion of the speed, resulting in the re-opening of the moving contact, causing a rebound of the moving contact. The re-opening stroke will depend on the approach speed, the nature of the materials, the pressing force maintaining the moving contact against the fixed contact. An electrical arc is generated during this re-opening which, depending on its intensity, will lead to the local melting of the materials of the contact areas. Depending on the conditions, there can be a single rebound or several consecutive rebounds, with damped amplitudes, until the kinetic energy of the moving contact is dissipated. At the end of the rebounds, the electrical contact is established on a molten section that, with time, will solidify. The risk of welding of the moving contact onto the fixed contact is latent. This leads in any case to an erosion of the contact areas that, if it is repeated, may become prejudicial to the normal operation of the electrical device.

One of the solutions to avoid these risks of welding is to differentiate the approach area from the permanent contact area. In the case of sliding contacts, the approach area can correspond to the chamfer lead, as in publications FR 2 524 195, FR 2 638 017 and EP 1 026 710. The making capacity of sliding contacts for short-circuit currents is limited to the power of the actuating mechanism that must oppose the Laplace forces. In addition, the closing of the contacts by sliding takes place while the current is applied, which leads inevitably to an erosion of the permanent contact areas, limiting the endurance of the device. A solution used in the case of pressure contacts is to equip the contact areas with tips, rivets or similar made out of different materials, of which one is generally refractory, in order to limit the risks of welding, or to provide a raised section acting as a spark arrestor, as in publication EP 1 085 610. The implementation of these embodiments is relatively costly.

Publication WO 2006/137687 A1 proposes a cut-off device provided with distinct mobile contacts for phase and neutral, having different lengths in order to generate different strokes, so as to shift the approach of said moving contacts in time. The time shift obtained is higher than 0.1 s, to let relays time to analyze the current in order to detect a possible malfunction. But this arrangement does not allow solving the problem posed.

SUMMARY OF THE INVENTION

The present invention aims to remedy these disadvantages by offering an electrical cut-off device provided with pressure contacts with high making capacity, even with short-circuit currents, in which the risks of welding and/or erosion of the permanent contact areas are significantly reduced or even suppressed, to achieve a high number of cycles, without deterioration of the quality of the electrical contact.

To that purpose, the invention relates to an electrical cut-off device of the kind indicated in the preamble, characterized in that it comprises at least one set of several moving contacts associated with said pair of fixed contacts, the moving contacts of said set being parallel and offset in space with respect to each other in order to stagger in time the approach of said moving contacts on said pair of fixed contacts when closing the electrical circuit, said set including at least one central moving contact that is ahead of the other moving contacts arranged laterally around said central moving contact, so that it is the first to establish the current when closing the electrical circuit and the last to cut off the current when opening said circuit.

This specific construction allows in particular differentiating the spark arrestor area from the permanent contact areas and minimizing the presence of the electric arc during closing by desynchronizing the rebounds thanks to the creation of approach time shifts of the order of 100 μs between two consecutive moving contacts in a same set.

The number of moving contacts can be determined according to the rating of said cut-off device, so that the current density for each moving contact does not exceed an intensity value of 15 kA for the peak current.

Depending on the rating of said cut-off device, said set can include two central moving contacts.

In a same set, the moving contacts are advantageously arranged symmetrically with respect to a centerline passing through the center of said set, and the lateral moving contacts are offset two by two with respect to said central moving contact in order to form stages.

In the preferred embodiment of the invention, the central moving contact includes a central boss that, when said cut-off module is in its switched-on position, extends in the free space between the fixed contacts of said pair. Depending on the ratings, the central moving contact can be associated with an insulating shield that replaces or complements said boss.

Each set of several moving contacts can be carried by an electrically insulating carriage coupled with said actuator mechanism.

This carriage includes advantageously a seat for each moving contact, in which each moving contact is pressed against said pair of fixed contacts by a return means. These seats have preferably different depths for positioning said moving contacts of a same set in stages.

BRIEF DESCRIPTION OF THE DRAWINGS

The present invention and its advantages will be better revealed in the following description of an embodiment given as a non limiting example, in reference to the drawings in appendix, in which.

DETAILED DESCRIPTION OF THE PREFERRED EMBODIMENTS

Figure 1:
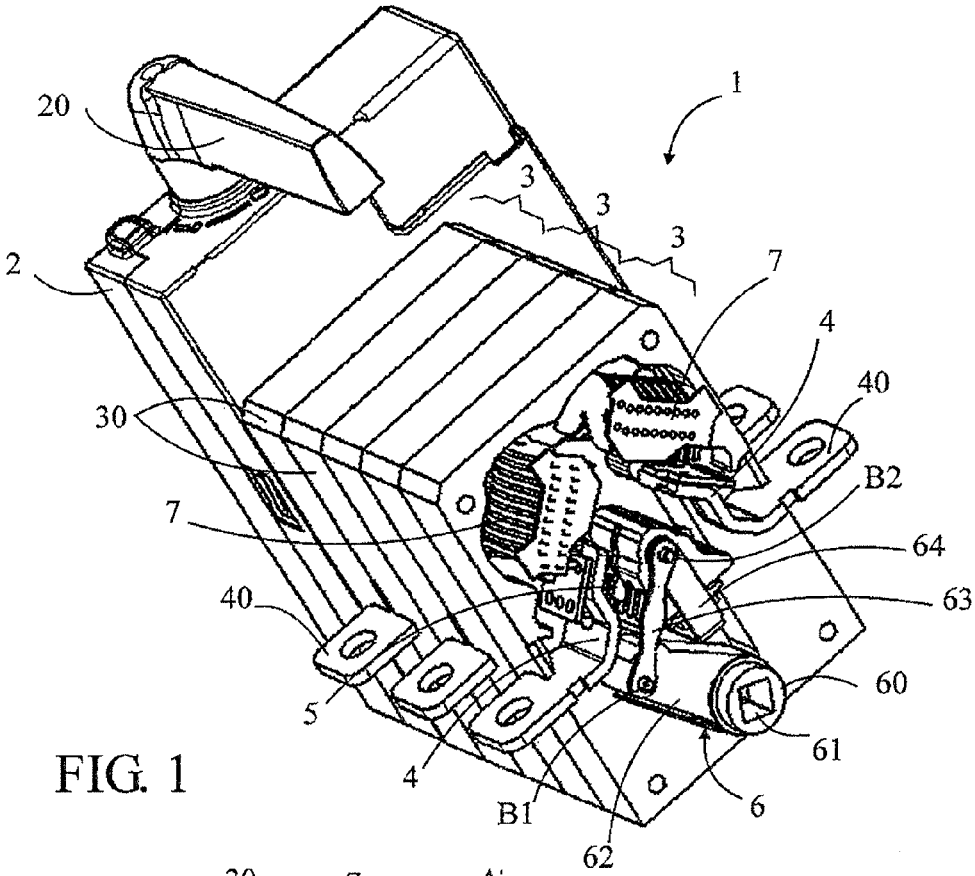
FIG. 1 is a perspective view of an electrical cut-off device according to the invention comprising a control module associated with three cut-off modules, in which the last cut-off module is open.

Referring to FIG. 1, the electrical cut-off device 1 object of the invention is usually made of a control module 2 associated with one or several cut-off modules 3 corresponding each to a phase of an electrical network. In the illustrated example, the device 1 comprises three cut-off modules 3. Each cut-off module 3 comprises in a known manner an insulating housing 30 inside of which at least two fixed contacts 4 forming a pair are seated, extending outside of said housing by means of connection terminals 40, and at least one moving contact 5 coupled with an actuator mechanism 6 controlled by the control module 2 in order to be moved between at least one switched-off position in which it is distant from the fixed contacts and the electrical circuit is open, and a switched-on position in which it is resting on the fixed contacts and the electrical circuit is closed. The control module 2 may be actuated manually by means of a handle 20 and/or automatically by means of a (non represented) motorization. In the represented example, the cut-off device 1 comprises splitting chambers 7 located above the fixed contacts 4 and the moving contact 5 to capture, stretch, cool down and extinguish the electric arc generated by the current at every status change of said device.

This cut-off device 1 must be able to establish and cut off currents I called normal or fault currents having a value from 0 to 10 In, In being the value of the rated current that can flow continuously through the device. This device must also be able to establish and if necessary cut off short-circuit currents whose value can reach 100 to 300 times the rated current In, without deterioration of the permanent contact areas, in order to guarantee a constant electric contact quality in time.

Figure 2:
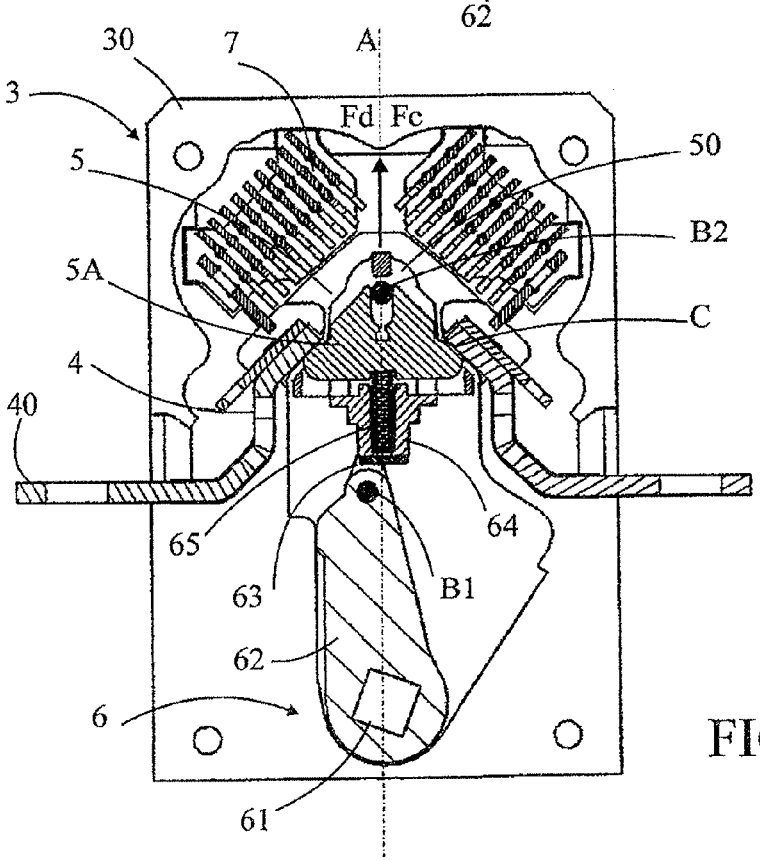
FIG. 2 is a cross-sectional view of a cut-off module of the device of FIG. 1 in switched-on position.

The solution of the invention is described in reference to an electrical device whose cut-off modules have a specific internal architecture, object of another patent application filed simultaneously, but it can of course apply to any other known architecture. In the example represented in FIGS. 1 and 2, the fixed contacts 4 and the moving contact 5 are arranged to form a current loop having an omega shape that is symmetrical with respect to a centerline A merged with the displacement axis Fd of the moving contact 5, in which the Laplace forces, also called compensation efforts Fc, generated by the current circulating in the current loop, are acting. The conductive parts that form the fixed contacts 4 are rigidly attached to the housing 30, bent substantially with an S-shape, arranged in opposition and separated by a free central space. The conductive part that forms the moving contact 5 has a width larger than the free space between the two fixed contacts 4 in order, in the switched-on position, to be pressed against the fixed contacts 4. Each of these conductive parts has a contact area C located in a plane inclined by an angle substantially equal to 45° with respect to the centerline A. This example is not restrictive, since the contact areas C can be comprised in a plane inclined with respect to the centerline A by an angle that can be comprised between 0 and 90°, the value 0° being excluded.

Figure 3:
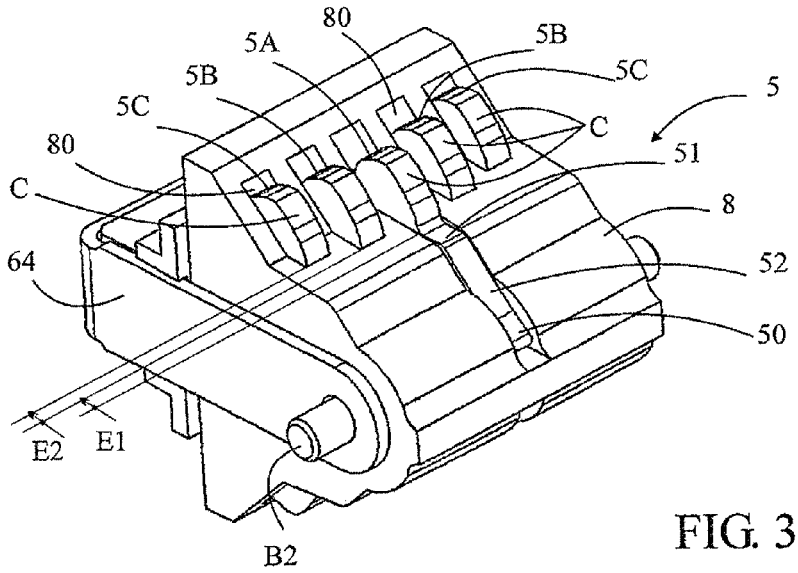
FIG. 3 is a perspective view of a set of moving contacts according to a first current rating.
Figure 4:
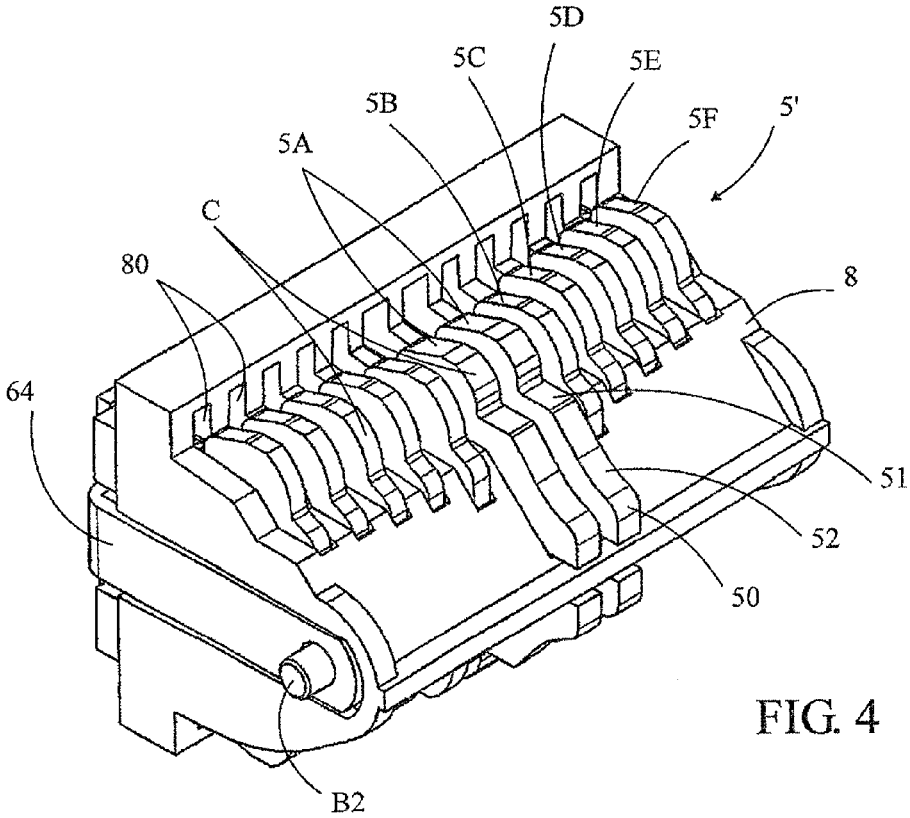
FIG. 4 is a view similar to FIG. 3 of a set of moving contacts according to a second current rating.

The cut-off device 1 according to the invention distinguishes itself from the state of the art by its moving contact 5 that is in fact made of a set 5, 5' of several parallel and offset moving contacts 5A-C, 5A-F allowing to stagger in time the approach of the moving contacts on the fixed contacts 4, and allowing not to exceed an intensity value of 10 to 15 kA for the peak current of each moving contact. Correspondingly, the fixed contacts 4 are dimensioned to provide a contact area C able to receive the plurality of moving contacts of a same set 5, 5'. The number of moving contacts per set 5, 5' can be determined according to the rating of the rated current In. FIGS. 3 and 4 illustrate two embodiment variants of a set of moving contacts, of which a first set 5 includes five moving contacts 5A-C and corresponds to a rating of 250 A with a peak value of 50 to 75 kA, and a second set 5' includes twelve moving contacts 5A-F and corresponds to a rating of 1600 A with a peak value of 120 to 150 kA. The sets 5, 5' are symmetrical with respect to the centerline A of the cut-off device 1 and comprise one or two central moving contact(s) 5A, which is(are) different from the other lateral moving contacts 5B-F. In the set of FIG. 3, the central moving contact 5A is centered on a centerline and in the set of FIG. 4, the two central moving contacts 5A are symmetrical with respect to a centerline. Each central moving contact 5A is larger and/or positioned ahead of the other ones in order to be the first to approach the fixed contacts 4 to establish the current, and the last to leave the fixed contacts 4 to cut off the current. It is subjected to the electric arc and therefore acts as a spark arrestor.

In the represented examples, the central moving contact 5A is made of a conductive part having the shape of a blade and comprising in its upper section a central boss 50 that gives it a substantially triangular shape, symmetrical with respect to centerline A. Of course, any other shape may be suitable. When the cut-off module 3 is in its switched-on position, the boss 50 extends in the free space between the fixed contacts 4 outside of the current loop. This boss 50 is connected with the contact areas C through a shoulder 51 that forms a nose, on which the electric arc generated by the current when closing and opening the electrical circuit positions itself, releasing thus quickly the contact areas C. This boss 50 then defines a slope 52 that rises in the direction of the compensation efforts Fc and accompanies the displacement of said electric arc, which is pushed by these compensation efforts Fc towards the splitting chambers 7. The central moving contact 5A can be complemented with a (non represented) insulating shield that extends instead of the boss 50 or is added to this boss 50 in order to facilitate the extinction of the electric arc, in particular in the case of low currents of the order of 0.1 In for example.

The other lateral moving contacts 5B-F are made of a conductive part having the shape of a blade that is symmetrical with respect to the centerline A and provided laterally with two contact areas C. They may have identical dimensions or not. They are at least identical two by two symmetrically with respect to a centerline.

The moving contacts 5A-C, 5A-F of a same set 5, 5' are seated in an electrically insulating carriage 8 delimiting separated and parallel seats 80 with different depths, so that the lateral moving contacts 5B-C, 5B-F are offset two by two with respect to the protuberant central moving contact 5A and form stages E1, E2. The stroke from one stage to the other may be equal or not. This carriage 8 can be made of one single part or of several assembled parts, these parts may be produced for example by molding of synthetic materials. The carriage 8 is coupled with the actuator mechanism 6.

In the represented example, the actuator mechanism 6 of the set 5, 5' of moving contacts comprises a drive shaft 60 linked in rotation with the handle 20 by means of a (non visible) angle transmission and/or controlled by a second (non represented) element fitted in the square bore 61. A system converting the rotary movement of the drive shaft 60 into a translation movement allows moving a carriage 64 carrying the carriage 8 along centerline A. This movement conversion system comprises a couple of jointed rods 62, 63, but any other equivalent means is conceivable. The first rod 62 is fixed to the drive shaft 60 and coupled in rotation with the second rod 63 by means of a first joint B1. The second rod 63 is coupled in rotation with the carriage 64, and simultaneously to the carriage 8, by means of a second joint B2. The carriage 64 is guided in translation with respect to housing 30 by means of rails, ribs or any other equivalent means, in which the protruding ends of the shaft forming the joint B2 are circulating.

A return means 65 is inserted between the carriage 64 and each moving contact 5A-C, 5A-F to exert a determined pressing effort on each of the moving contacts when it is pressed against the fixed contacts 4. In the illustrated configuration, this pressing effort adds to the compensation efforts Fc generated by current I.

Figure 5A:
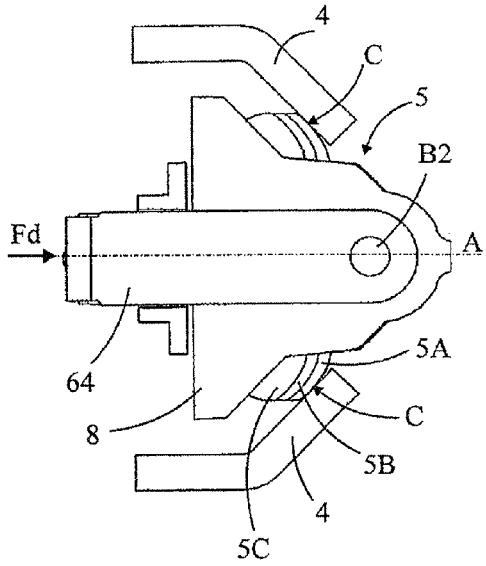
FIGS. 5A to 5C are side views of the fixed and moving contacts of the cut-off module of FIG. 2, in three approach positions during the closing of the electrical circuit.
Figure 5B:
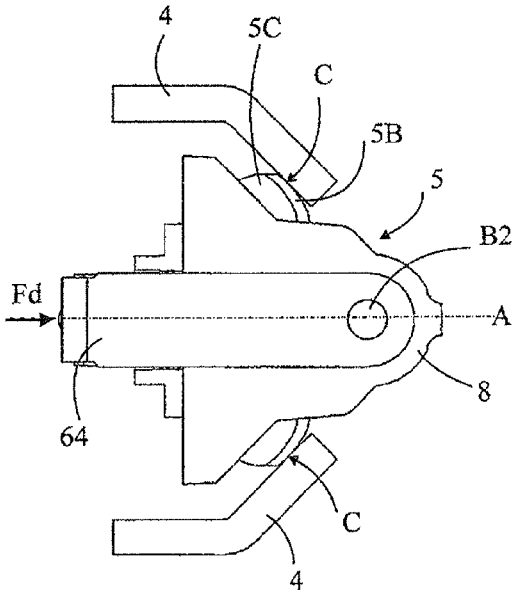
Figure 5C:
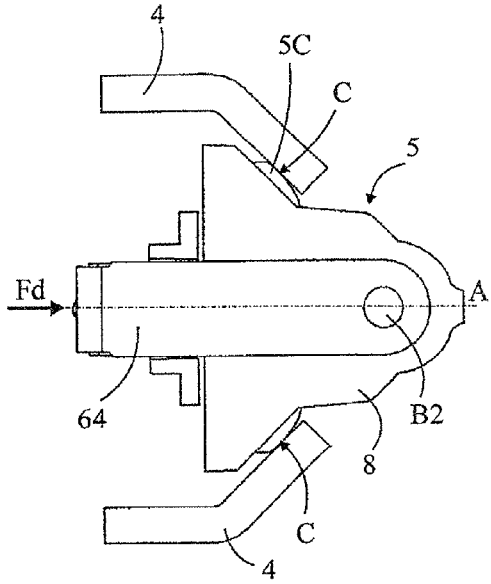

FIGS. 5A to 5C illustrate in three steps the approach of the set 5 of moving contacts 5A-5C of FIG. 3 to the fixed contacts 4 of a cut-off module 3 to close the electrical circuit. When switching on the cut-off module 3, when the carriage 64 is displaced in direction Fd towards the fixed contacts 4 by the actuator mechanism 6, the approach of the fixed contacts 4 is performed by the central moving contact 5A, which is ahead of the others and is the first that is subjected to a rebound (see FIG. 5A). Some 100 μs later, the second moving contacts 5B, which surround the central moving contact 5A, close on the fixed contacts 4, short-circuiting the electric arc generated during the rebound of the central moving contact 5A, and are in turn subjected to a rebound (see FIG. 5B). Then, some 100 μs later, the third moving contacts 5C, which follow, close in turn on the fixed contacts 4, short-circuiting the electric arc generated during the rebounds of the second moving contacts 5B (see FIG. 5C), and are in turn subjected to a rebound. The central moving contact 5A, which was the first to close, finishes its rebound stroke, short-circuiting the electric arc generated during the rebounds of the third moving contacts 5C. And so on, until the stabilization of the rebounds. The total duration of the presence of the electric arc, as well as the punctual duration of the presence of the electric arc during every approach, are significantly reduced, allowing to achieve a high number of closing cycles and an increased endurance.

On the other hand, when opening the electrical circuit, the lateral moving contacts 5B-C, 5B-F are totally free of any electric arc, since the electric arc only appears on the central moving contact 5A when it leaves last the fixed contacts 4. Consequently, the lateral moving contacts 5B-C, 5B-F are not subjected to any wear, erosion or local melting due to the electric arc, and they fully take part in the permanent passage of the electrical current.

This description shows clearly that the invention allows reaching the goals defined, in particular the multiplication of the moving contacts and their shift in time that allow minimizing the negative effects of the rebounds generated when closing the electrical circuit. This shift allows in fact desynchronizing the rebounds of each moving contact and minimizing the time during which no moving contact is in physical contact with the fixed contact. This increases significantly the electrical endurance of the cut-off device.

The present invention is not restricted to the examples of embodiment described, but extends to any modification and variant which is obvious to a person skilled in the art while remaining within the scope of the protection defined in the attached claims.

The invention claimed is:

1. An electrical cut-off device (1) with high making capacity provided with a control module (2) associated with at least one cut-off module (3) corresponding to a phase of an electrical network, the cut-off module comprising:

at least one moving contact (5) associated with at least one pair of fixed contacts (4), the at least one moving contact (5) being coupled with an actuator mechanism (6) controlled by the control module (2) so as to be movable between at least one switched-off position, in which the at least one moving contact is spaced from the at least one pair of fixed contacts and the electrical circuit is open, and a switched on position in which the moving contact is resting on the at least one pair of fixed contacts and the electrical circuit is closed, wherein the electrical cut-off device (1) comprises at least one set (5, 5') of several moving contacts (5A-C; 5A-F) associated with the pair of fixed contacts (4), the at least one set of several moving contacts (5, 5') are parallel and offset in space with respect to each other in order to stagger in time approach of the moving contacts on the pair of fixed contacts when closing the electrical circuit, the at least one set of several moving contacts (5, 5') including at least one central moving contact (5A) arranged ahead of the other moving contacts (5B-C; 5B-F) arranged laterally around the central moving contact (5A) so that the at least one central moving contact (5A) is the first to establish current when closing the electrical circuit and the last to interrupt current when opening the circuit.

2. The device according to claim 1, wherein the at least one set of several moving contacts (5, 5') comprises a number of moving contacts (5A-C; 5A-F) determined according to a rating of the cut-off device (1) so that a current density, for each moving contact, does not exceed an intensity value of 15 kA at a peak current.

3. The device according to claim 1, wherein the at least one central moving contact (5A) comprises two central moving contacts (5A).

4. The device according to claim 1, wherein, in the at least one set of several moving contacts (5, 5'), the moving contacts (5A-C; 5A-F) are arranged symmetrically with respect to a centerline passing through the center of the set.

5. The device according to claim 4, wherein, in the at least one set of several moving contacts (5, 5'), the lateral moving contacts (5B-C; 5B-F) are offset two by two with respect to the central moving contact (5A) in order to form stages (E1, E2).

6. The device according to claim 1, wherein the central moving contact (5A) includes a central boss (50) that, when the cut-off module (3) is in the switched-on position, extends in a free space between the pair of the fixed contacts (4).

7. The device according to claim 1, wherein the central moving contact (5A) is associated with an insulating screen that, when the cut-off module (3) is in its switched-on position, extends in a free space between the pair of the fixed contacts (4) located outside of a current loop.

8. The device according to claim 1, wherein each set (5, 5') of several moving contacts (5A-C; 5A-F) is carried by an electrically insulating carriage (8) coupled with the actuator mechanism (6).

9. The device according to claim 8, wherein the carriage (8) includes a seat (80) for each moving contact in which each moving contact is pressed against the pair of fixed contacts (4) by a return mechanims (65).

10. The device according to claim 9, wherein the seats (80) of a same carriage (8) have different depths for positioning the moving contacts (5A-C; 5A-F) of a same set of several moving contacts (5, 5') in stages.

11. An electrical cut-off device (1) with high making capacity provided with a control module (2) and at least one cut-off module (3) that corresponds to a phase of an electrical network, the cut-off module comprising:

a plurality of moving contacts (5), each of the moving contacts being engagable with a respective pair of fixed contacts (4);

the moving contacts (5) being coupled with an actuator mechanism (6) that is controlled by the control module (2) such that the moving contacts are movable between a switched-off position, in which the moving contacts are spaced from the respective pairs of fixed contacts and an electrical circuit is open, and a switched-on position in which the moving contacts abut the respective pairs of fixed contacts and the electrical circuit is closed;

the plurality of moving contacts are parallel and offset in space with respect to each other such that, when the moving contacts move from the switched-off position to the switched-on position, a central moving contact abuts a central pair of the fixed contacts to establish a flow of current before others of the moving contacts abut others of the respective pairs of fixed contacts; and when the moving contacts move from the switched-on position to the switched-off position, the central moving contact disengages the central pair of the fixed contacts to interrupt the flow of current after the others of the moving contacts have disengaged the others of the respective pairs of fixed contacts.

12. The device according to claim 11, wherein the cut-off module comprises the central moving contact and at least secondary and tertiary moving contacts, the central moving contact being engagable with the central pair of fixed contacts, the secondary moving contact being engagable with a second pair of fixed contacts, the tertiary moving contact being engagable with a third pair of fixed contacts, the central, the secondary and the tertiary moving contacts being arranged such that, when the central, the secondary and the tertiary moving contacts move from the switched-off position to the switched-on position, the central moving contact abuts the central pair of fixed contacts first, then the secondary moving contact abuts the second pair of fixed contacts and then the tertiary moving contact abuts the third pair of fixed contacts; and when the central, the secondary and the tertiary moving contacts move from the switched-on position to the switched-off position, the tertiary moving contact disengages the third pair of fixed contacts first, then the secondary moving contact disengages the second pair of fixed contacts, and then the central moving contact disengages the central pair of fixed contacts.

13. The device according to claim 12, wherein the cut-off module comprises two secondary moving contacts and two tertiary moving contacts, the central moving contact, the two secondary moving contacts and the two tertiary moving contacts are arranged such that the two secondary moving contacts are located between the two tertiary moving contacts and the central moving contact is located between the two secondary moving contacts.

* * * * *